US010590576B2

(12) United States Patent
Minami et al.

(10) Patent No.: US 10,590,576 B2
(45) Date of Patent: Mar. 17, 2020

(54) STERIC NET-LIKE FIBER AGGREGATION

(71) Applicant: PANEFRI INDUSTRIAL CO., LTD., Kyoto (JP)

(72) Inventors: Masaharu Minami, Kyoto (JP); Masaomi Koga, Kyoto (JP); Michihiko Kotani, Kyoto (JP)

(73) Assignee: PANEFRI INDUSTRIAL CO., LTD., Kyoto (JP)

( * ) Notice: Subject to any disclaimer, the term of this patent is extended or adjusted under 35 U.S.C. 154(b) by 103 days.

(21) Appl. No.: 15/322,843

(22) PCT Filed: Jul. 3, 2015

(86) PCT No.: PCT/JP2015/069308

§ 371 (c)(1),
(2) Date: Dec. 29, 2016

(87) PCT Pub. No.: WO2016/002940

PCT Pub. Date: Jan. 7, 2016

(65) Prior Publication Data

US 2017/0121876 A1 May 4, 2017

(30) Foreign Application Priority Data

Jul. 4, 2014 (JP) ..... 2014-139015

(51) Int. Cl.

| | |
|---|---|
| ***D04H 3/007*** | (2012.01) |
| ***D04H 3/033*** | (2012.01) |
| ***D04H 3/16*** | (2006.01) |
| ***D04H 3/14*** | (2012.01) |
| ***D04H 3/016*** | (2012.01) |
| ***D04H 3/03*** | (2012.01) |

(52) U.S. Cl.

CPC ..... *D04H 3/007* (2013.01); *D04H 3/016* (2013.01); *D04H 3/03* (2013.01); *D04H 3/033* (2013.01); *D04H 3/14* (2013.01); *D04H 3/16* (2013.01)

(58) Field of Classification Search

CPC ..... D04H 3/007; D04H 3/16; D04H 3/033; Y10T 442/60

See application file for complete search history.

(56) References Cited

U.S. PATENT DOCUMENTS

| | | | | |
|---|---|---|---|---|
| 4,130,535 A | | 12/1978 | Coran et al. | |
| 5,587,229 A | * | 12/1996 | Clementini | D01F 6/30 428/365 |
| 5,733,825 A | * | 3/1998 | Martin | D01D 5/0885 156/209 |
| 5,811,186 A | * | 9/1998 | Martin | B24D 11/005 428/373 |
| 6,274,237 B1 | | 8/2001 | Nakajima et al. | |
| 7,019,081 B2 | * | 3/2006 | Datta | C08L 23/10 525/240 |
| 2006/0198983 A1 | * | 9/2006 | Patel | D04H 1/02 428/92 |
| 2009/0068912 A1 | * | 3/2009 | Boscolo | D01D 5/0985 442/329 |
| 2010/0029164 A1 | * | 2/2010 | Datta | C08L 23/10 442/414 |
| 2012/0121882 A1 | | 5/2012 | Okaya | |
| 2016/0237603 A1 | * | 8/2016 | Taninaka | D04H 3/007 |

FOREIGN PATENT DOCUMENTS

| | | | |
|---|---|---|---|
| JP | S55-18448 | B | 5/1980 |
| JP | H06-116855 | A | 4/1994 |
| JP | H07-032517 | A | 2/1995 |
| JP | H07-060861 | A | 3/1995 |
| JP | 2001-159026 | A | 6/2001 |
| JP | 2002-266223 | A | 9/2002 |
| JP | 2003-166139 | A | 6/2003 |
| JP | 2006-044091 | A | 2/2006 |
| JP | 2006-283278 | A | 10/2006 |
| JP | 2009-82446 | A | 4/2009 |
| JP | 2010-516836 | A | 5/2010 |
| JP | 2010-121019 | A | 6/2010 |
| JP | 2010-523758 | A | 7/2010 |
| JP | 5454733 | B | 1/2014 |
| JP | 5459436 | B | 1/2014 |
| JP | 5459438 | B | 1/2014 |
| WO | 98/23800 | | 6/1998 |
| WO | WO 2008/091432 | A2 | 7/2008 |
| WO | WO 2008/123988 | A1 | 10/2008 |

(Continued)

OTHER PUBLICATIONS

HMC Technical Data Sheet for Polyproylene chemical resistance, hmcpolymer.com (Year: 2012).*

(Continued)

*Primary Examiner* — Jennifer A Steele

(74) *Attorney, Agent, or Firm* — Renner, Otto, Boisselle & Sklar, LLP

(57) ABSTRACT

There is provided a steric net-like fiber aggregation, comprising fibers having a fineness of 150 to 100000 dtex, the fibers being made of a resin comprising a propylene-based polymer(a), wherein a multitude of the fibers are in a fusion bonding with each other due to a random orientation of melted fibers, and wherein the propylene-based polymer(a) has a structural unit of 51 to 95 percent by mole of a propylene and 5 to 49 percent by mole of an α-olefin with respect to 100 percent by mole of the total monomers of the propylene-based polymer(a).

13 Claims, No Drawings

(56) References Cited

FOREIGN PATENT DOCUMENTS

| | | |
|---|---|---|
| WO | WO 2009/033540 | 3/2009 |
| WO | WO 2011/007875 A1 | 1/2011 |

OTHER PUBLICATIONS

International Search Report for related International Application No. PCT/JP2015/069308 dated Oct. 6, 2015.
Notice of Reasons for Revocation of Japanese Patent No. 5894716, dated Nov. 16, 2016.
Notice of Reasons for Revocation for corresponding Japanese Patent No. 5873225, dated Dec. 2, 2016.
Extended European Search Report for corresponding European Application No. 15814701.7 dated Dec. 21, 2017.
Notice of Maintenance of Patent issued in Japanese Patent No. 5873225 dated Jun. 8, 2017 and partial English translation.
Notice of Maintenance of Patent issued in Japanese Patent No. 5894716 dated May 25, 2017 and partial English translation.
English translation of International Preliminary Report on Patentability for International Application No. PCT/JP2015/069308, dated Jan. 19, 2017.
English translation of International Preliminary Report on Patentability for International Application No. PCT/JP2015/069309, dated Jan. 19, 2017.
English translation of Notice of Reasons of Revocation of Japanese Patent No. 5873225, dated Dec. 1, 2016.
English translation of Notice of Reasons of Revocation of Japanese Patent No. 5894716, dated Nov. 15, 2016.
Office Action for corresponding European Application No. 15814701.7 dated Aug. 13, 2019.

* cited by examiner

STERIC NET-LIKE FIBER AGGREGATION

TECHNICAL FIELD

The present invention relates to a steric net-like fiber aggregation which comprises fibers made of a resin comprising a propylene-based polymer. In particular, the present invention relates to the steric net-like fiber aggregation wherein a multitude of the fibers are in a fusion bonding with each other due to a random orientation of melted fibers.

BACKGROUND OF THE INVENTION

Heretofore, a cotton, a foamed polyurethane or the like has been used for a seat for an automobile or train, and also for a cushion material for a medical appliance or household furniture. The foamed polyurethane is widely used since its strength can be readily changed by a foam density or a kind of a specific resin of the polyurethane, and also the foamed polyurethane has an excellence in its resilience when being compressed. The foamed polyurethane, however, may have a harmful effect on the human body when a skin of the human body makes contact with the polyurethane. The reason for this is that a residual monomer or the like in the foamed polyurethane has an irritating property with respect to the human body, the residual monomer being due to a polymerization process for the foamed polyurethane. Moreover, the foamed polyurethane does not sufficiently allow the air to pass therethrough, thereby making it undesirable to use the foamed polyurethane in some field. While on the other hand, the cotton is not involved in the problem of the residual monomer as described above. However, the cotton may be insufficient for its use as the cushion material since the fibers of the cotton tend to undergo a biased position in the use of the cushion.

There has been provided an aggregation wherein spun fibers made of thermoplastic resin such as polyester resin and the like are shaped into a form of net (see Japanese Patent Publication Nos. 5459436 and 5459438). In recent years, such aggregation has been increasingly used in various fields since it is not associated with the problems such as the irritating residual monomer and the biased position of the fibers, and also it has a sufficiency in an air permeability.

PATENT DOCUMENTS (RELATED ART PATENT DOCUMENTS)

PATENT DOCUMENT 1: Japanese Patent Publication No. 5459436

PATENT DOCUMENT 2: Japanese Patent Publication No. 5459438

DISCLOSURE OF THE INVENTION

Problems To Be Solved by the Invention

The inventors of the present application have found that the net-like aggregation with its spun fibers being made of the thermoplastic resin, i.e., the polyester resin or the like is not appropriate for its use in the field of medical application or nursing-care application since such aggregation is partially dissolved and/or it generates odor by a chemical treatment thereof. More specifically, in a case where the net-like aggregation is used in the medical or nursing-care field, such aggregation is required to be subjected to a cleaning process or the like as the chemical treatment so as to prevent an infection with a virus or a bacterium. The cleaning of the net-like aggregation can cause the aggregation to be deformed, which is inappropriate for a repetitive use of the aggregation. And also the cleaning of the net-like aggregation can cause the aggregation to generate odor therefrom to give a sense of discomfort with respect to the user thereof. Moreover, the thermoplastic resin, i.e., the polyester resin or the like often includes an oil component mixed therein, thereby causing an oil bleeding to occur in the surface of the resin as time proceeds, which leads to a sticky feeling and/or a contamination of medical products. As such, the aggregation made of the polyester resin or the like is not appropriate for its use in the medical or nursing-care application.

A main object of the present invention is to provide a steric net-like fiber aggregation having an improved chemical resistance and a less odor.

Means for Solving the Problems

In order to achieve the above object, the present invention provides a steric net-like fiber aggregation comprising fibers made of a resin comprising a propylene-based polymer(a), wherein a multitude of the fibers in the aggregation are in a fusion bonding with each other due to a random orientation of melted fibers. Namely, the present invention provides the steric net-like fiber aggregation having a propylene as a main component of a structural unit thereof. The steric net-like fiber aggregation according to the present invention can also be referred to as "propylene-based steric net-like fiber aggregation".

The present invention includes a preferred embodiment of the aggregation as described below. That is, the steric net-like fiber aggregation according to the preferred embodiment of the present invention comprises fibers made of the resin comprising the propylene-based polymer(a), wherein a multitude or plurality of the fibers in the aggregation are in the fusion bonding with each other due to the random orientation of melted fibers, and wherein the propylene-based polymer(a) has a structural unit of 51 to 95 percent by mole of a propylene and 5 to 49 percent by mole of an α-olefin with respect to 100 percent by mole of the total monomers of the propylene-based polymer(a). In one embodiment of the present invention, the fineness of each of the fibers in the aggregation is in the range of 150 to 100000 dtex. The steric net-like fiber aggregation according to the present invention has an improved chemical resistance and a less odor.

Effect of the Invention

The improved chemical resistance of the steric net-like fiber aggregation according to the present invention allows the chemical treatment to be positively carried out to prevent the infection with the virus or the bacterium. This makes it possible for the steric net-like fiber aggregation to be always kept in a clean condition even though the aggregation is repetitively used. Moreover, the steric net-like fiber aggregation according to the present invention is unlikely to give a sense of discomfort with respect to the user thereof, the discomfort being attributed to the odor from the aggregation.

MODES FOR CARRYING OUT THE INVENTION

An embodiment of the present invention will be described in more detail. The steric net-like fiber aggregation of the present invention is composed of fibers made of a resin comprising a propylene-based polymer(a).

The propylene-based polymer(a) contained in the resin is a polymer which mainly consists of propylene. Preferably, the propylene-based polymer(a) is a copolymer comprising a polypropylene or propylene. In this regard, the propylene-based polymer(a) in the present invention is preferably the copolymer of the propylene and an α-olefin since it enables the steric net-like fiber aggregation to exhibit an improved chemical resistance and a less odor, thereby making it unlikely to give a sense of discomfort with respect to the user thereof. The phrase "polymer which mainly consists of propylene" used herein means that the polymer comprises, as a structural unit, at least 51 percent by mole of a propylene, preferably 60 or more percent by mole of the propylene, more preferably 70 or more percent by mole of the propylene, still more preferably 80 or more percent by mole of the propylene, and the most preferably 90 or more percent by mole of the propylene, with respect to 100 percent by mole of the total monomers of the propylene-based polymer(a). While on the other hand, the propylene-based polymer(a) comprises, as the structural unit thereof, typically 95 or less percent by mole of the propylene, preferably 93 or less percent by mole of the propylene, more preferably 90 or less percent by mole of the propylene, still more preferably 85 or less percent by mole of the propylene, and the most preferably 80 or less percent by mole of the propylene with respect to 100 percent by mole of the total monomers of the propylene-based polymer(a). The propylene-based polymer(a) may comprise the structural unit of the propylene typically in the range of 51 to 95 mol %, preferably in the range of 60 to 90 mol %, still preferably in the range of 70 to 80 mol % with respect to 100 mol % of the total monomers of the propylene-based polymer(a). The above propylene content of the structural unit in the propylene-based polymer(a) enables the steric net-like fiber aggregation to exhibit the more improved chemical resistance and the less odor. A mole fraction (i.e., "percent by mole" or "mol %") of the polymer in the present invention can be determined by a monomer feeding ratio in a polymer production, an infrared spectroscopic analysis (IR), or a nuclear magnetic resonance spectrometer (NMR), in which case the mole fraction means a mole ratio of a subject monomer where numbers for total monomers forming the polymer are regarded as "100 mol %".

The α-olefin is one in which the number of the contained carbon atoms is preferably in the range of 2 to 20, more preferably in the range of 2 to 10, for example in the range of 2 to 6. Examples of such α-olefin include ethylene, 1-butene, 1-pentene, 1-hexene, 4-methyl-1-pentene, 1-heptene, 1-octene, 1-nonene, 1-decene and the like. Such α-olefin may be contained in the propylene-based polymer (a) as a single component of the above, or may also be contained in the propylene-based polymer(a) in the combined form of at least two of the above. From a viewpoint that the steric net-like fiber aggregation becomes to have a favorable elasticity and strength, it is preferred that the α-olefin is at least one selected from a group consisting of ethylene, 1-butene, 1-pentene, 1-hexene and 1-octene. It is more preferred that the α-olefin is at least one selected from a group consisting of ethylene, 1-butene, 1-hexene and 1-octene. It is still more preferred that the α-olefin is at least one selected from a group consisting of ethylene and 1-butene. It is highly preferred that the α-olefin is ethylene. The α-olefin corresponding to the above makes it possible for the steric net-like fiber aggregation to not only have the improved elasticity and strength, but also exhibit the more improved chemical resistance and the further less odor.

In a case where the propylene-based polymer(a) is a copolymer of the propylene and the α-olefin, the propylene-based polymer(a) comprises, as a structural unit, typically 5 or more percent by mole of the α-olefin, preferably 10 or more percent by mole of the α-olefin, more preferably 15 or more percent by mole of the α-olefin, still more preferably 20 or more percent by mole of the α-olefin, for example 25 or more percent by mole of the α-olefin, with respect to 100 percent by mole of the total monomers of the propylene-based polymer(a). While on the other hand, the propylene-based polymer(a) comprises, as the structural unit, typically 49 or less percent by mole of the α-olefin, preferably 45 or less percent by mole of the α-olefin, more preferably 40 or less percent by mole of the α-olefin, still more preferably 35 or less percent by mole of the α-olefin, the most preferably 30 or less percent by mole of the α-olefin with respect to 100 percent by mole of the total monomers of the propylene-based polymer(a). The propylene-based polymer(a) may comprise the structural unit of the α-olefin typically in the range of 5 to 49 mol %, preferably in the range of 10 to 40 mol %, still preferably in the range of 20 to 30 mol % with respect to 100 mol % of the total monomers of the propylene-based polymer(a). The above α-olefin content of the structural unit in the propylene-based polymer(a) enables the steric net-like fiber aggregation to exhibit the more improved chemical resistance and the less odor.

In addition to the propylene and/or α-olefin, the propylene-based polymer(a) may further contain a small amount of a structural unit derived from another copolymerizable monomer. As for the ratio of the structural unit derived from such another copolymerizable monomer in the propylene-based polymer(a), it is preferably 20 or less percent by mole, more preferably 10 or less percent by mole, still more preferably 5 or less percent by mole, with respect to 100 percent by mole of the total monomers of the propylene-based polymer(a).

The propylene-based polymer(a) according to the present invention may have the α-olefin incorporated thereinto in a random form, a block form, a graft form, a tapered form. From a viewpoint that the propylene-based polymer(a) becomes to have a favorable elasticity, it is preferred that the α-olefin incorporated into the propylene-based polymer(a) is in the form of random.

The propylene-based polymer(a) has a molecular weight distribution $M_w/M_n$ of preferably 4.0 or less, more preferably 3.0 or less, still more preferably 2.8 or less, for example 2.6 or less. While on the other hand, the propylene-based polymer(a) typically has the molecular weight distribution $M_w/M_n$ of 1.01 or more. The propylene-based polymer(a) may have the molecular weight distribution $M_w/M_n$ preferably in the range of 1.01 to 4.0, more preferably in the range of 1.1 to 3.0, still more preferably in the range of 1.5 to 2.8, for example in the range of 2.0 to 2.6. The above molecular weight distribution $M_w/M_n$ of the propylene-based polymer (a), which leads to a reduction in a lower-molecular component and thus a reduction in a volatile component, enables the steric net-like fiber aggregation to exhibit the less odor and the more improved chemical resistance. It is desired that such propylene-based polymer(a) is a metallocene-catalyzed polymer. The molecular weight distribution $M_w/M_n$ of the propylene-based polymer(a) can be adjusted by the kind of metallocene catalyst, a process condition of polymerization (e.g., polymerization temperature, polymerization pressure) or the like.

The number-average molecular weight "$M_n$" and the weight-average molecular weight "$M_w$" according to the present invention can be obtained by a determination using Gel Permeation Chromatography where a polystyrene conversion is performed for a calibration.

The weight-average molecular weight $M_w$ of the propylene-based polymer(a) is preferably in the range of 10000 to 1000000, more preferably in the range of 20000 to 800000, still more preferably in the range of 30000 to 500000, the most preferably in the range of 100000 to 400000. The above weight-average molecular weight $M_w$ of the propylene-based polymer(a), which leads to favorable tensile performance and compression set of the steric net-like fiber aggregation, enables the steric net-like fiber aggregation to exhibit the more improved chemical resistance and the further less odor.

The "MFR" of the propylene-based polymer(a) is typically in the range of 0.5 to 60 g per 10 minutes, preferably in the range of 1 to 45 g per 10 minutes, more preferably in the range of 5 to 35 g per 10 minutes. The above range of the MFR in the propylene-based polymer(a) makes it possible to improve a formability of the resin.

The MFR of the propylene-based polymer(a) may be determined according to JIS K7210 (230° C., 2.16 kg-load).

The melting peak temperature of the propylene-based polymer(a) is preferably 125° C. or higher. Such melting peak temperature is desirable in terms of a heating resistance of the aggregation in a high-temperature treatment of the aggregation.

The flexural modulus of the propylene-based polymer(a) is typically 600 MPa or less, preferably 500 MPa or less, more preferably 400 MPa or less, still more preferably 300 MPa or less, for example 200 MPa or less. While on the other hand, the flexural modulus of the propylene-based polymer(a) may be 20 MPa or more.

The flexural modulus can be determined according to JIS K7171:1982.

As for a production of the propylene-based polymer(a), it is not limited to a particular one. The conventional production process can be utilized as the production of the propylene-based polymer(a). Examples of the commercially available product of the propylene-based polymer(a), which can be alternatively utilized in the present invention, include WELNEX™ and WINTEC™, both of which are series produced by Japan Polypropylene Corporation.

The resin in the steric net-like fiber aggregation may be a polymer alloy made of the propylene-based polymer(a) and a propylene homopolymer(b). The polymer alloy of the steric net-like fiber aggregation enables the steric net-like fiber aggregation of the present invention to exhibit an improved heat resistance as well as the more improved chemical resistance and the less odor. The term "polymer alloy" used herein means a composite made of two or more kinds of resin(s) and/or inorganic material(s), the composite being a composite material of the resin(s) and/or inorganic material(s) obtained by a mixing thereof. More preferably, the polymer alloy in the present invention may be a blended material of the propylene-based polymer(a) and the propylene homopolymer(b). Such blended material may further contain an additive agent or the like.

The weight-average molecular weight $M_w$ of the propylene homopolymer(b) is preferably in the range of 10000 to 1000000, more preferably in the range of 20000 to 800000, still more preferably in the range of 50000 to 600000, and the most preferable in the range of 100000 to 500000. The above weight-average molecular weight $M_w$ of the propylene homopolymer(b) enables the steric net-like fiber aggregation to have a sufficient mechanical strength as well as the more improved chemical resistance and the further less odor.

The propylene homopolymer(b) has a molecular weight distribution $M_w/M_n$ of preferably 2.0 or more, more preferably 2.5 or more, still more preferably 3.0 or more, and the most preferably 3.3 or more. While on the other hand, the propylene homopolymer(b) also has the molecular weight distribution $M_w/M_n$ of preferably 6.0 or less, more preferably 5.0 or less, still more preferably 4.5 or less, and the most preferably 4.0 or less. The propylene homopolymer(b) may have the molecular weight distribution $M_w/M_n$ preferably in the range of 2.0 to 6.0, more preferably in the range of 2.5 to 5.0, still more preferably in the range of 2.5 to 4.5, for example in the range of 3.0 to 4.0. The above molecular weight distribution $M_w/M_n$ of the propylene homopolymer (b), which leads to a reduction in a lower-molecular component and thus a reduction in a volatile component, enables the steric net-like fiber aggregation to exhibit the less odor and the more improved chemical resistance.

The MFR of the propylene homopolymer(b) is, but not limited to, typically in the range of 0.5 to 60 g per 10 minutes, preferably in the range of 1 to 45 g per 10 minutes, and more preferably in the range of 5 to 35 g per 10minutes. The above range of the MFR in the propylene homopolymer (b) makes it possible to improve a formability of the resin.

As for a production of the propylene homopolymer(b), it is not limited to a particular one. The conventional production process can be utilized as the production of the propylene homopolymer(b). Examples of the commercially available product of the propylene homopolymer(b), which can be alternatively utilized in the present invention, include PRIMEPOLYPRO™ PP produced by Prime Polymer Co., Ltd, NOVATEC™ PP produced by Japan Polypropylene Corporation, and the like.

In a case where the resin in the steric net-like fiber aggregation is a polymer alloy made of the propylene-based polymer(a) and the propylene homopolymer(b), the polymer alloy comprises preferably 4 or more percent by weight of the propylene homopolymer(b), more preferably 10 or more percent by weight of the propylene homopolymer(b), and still more preferably 20 or more percent by weight of the propylene homopolymer(b), with respect to 100 percent by weight of the whole resin of the aggregation. While on the other hand, the polymer alloy also comprises preferably 90 or less percent by weight of the propylene homopolymer(b), more preferably 80 or less percent by weight of the propylene homopolymer(b), and still more preferably 70 or less percent by weight of the propylene homopolymer(b) with respect to 100 percent by weight of the whole resin of the aggregation. The polymer alloy in the steric net-like fiber aggregation may comprise the propylene homopolymer(b) preferably in the range of 10 to 80 weight %, more preferably in the range of 20 to 70 weight % with respect to 100 weight % of the whole resin of the aggregation. The above content of the propylene homopolymer(b) in the polymer alloy enables the steric net-like fiber aggregation to exhibit the improved heat resistance as well as the more improved chemical resistance and the less odor.

In a case where the resin in the steric net-like fiber aggregation is a polymer alloy made of the propylene-based polymer(a) and the propylene homopolymer(b), the resin may contain a further polymer in addition to the propylene-based polymer(a) and the propylene homopolymer(b). Examples of the further polymer include a polyester-based thermoplastic elastomer, a polyurethane-based thermoplastic elastomer, a polyamide-based elastomer, and a polyethylene. The resin in the steric net-like fiber aggregation may contain various kinds of additive agents. Examples of the additive agent include an antioxidant, a heat stabilizer, a flame retardant, a pigment, a light stabilizer, an ultraviolet absorber, an inorganic filler, a foaming agent, a colorant, an antiblocking agent, a lubricant, an antistatic agent and a plasticizer. The resin in the steric net-like fiber aggregation may also contain inorganic- or organic-filler such as a glass filler and a carbon filler.

The steric net-like fiber aggregation according to the present invention has a three-dimensional net-like structure which can be obtained by subjecting a multitude or plurality of melted fibers to a fusion bonding with each other in a random or spiral orientation, the fibers being made of the resin comprising the propylene-based polymer(a). The contact of the melted fibers with each other enables the fibers to have the fusion bonding with each other, thereby making it possible for the steric net-like fiber aggregation to become to have its strong structure as a three-dimensional net-like structure. The phrase "random orientation" used herein means that the fibers respectively have disorderly meandering forms in the aggregation. The phrase "spiral orientation" used herein means that the fibers respectively extend while being in a rotating form in the aggregation, the extending being perpendicular to a rotation plane of the rotating form. The phrase "a multitude of fibers" used in the present invention means that fibers have the number required for a shape retention of the steric net-like fiber aggregation. More specifically, the multitude of fibers can correspond to the number of pores provided in a T-die for extruding the resin material to form the fibers. For example, the multitude of fibers can correspond to such an embodiment that about 50 to about 1800 fibers are provided in the steric net-like fiber aggregation having the width dimension of 1000 mm and the thickness dimension of 30 mm.

The fineness of the fiber is 150 dtex or more, preferably 300 dtex or more, more preferably 1000 dtex or more, and the most preferably 100000 dtex or more. While on the other hand, the fineness of the fiber is also preferably 80000 dtex or less, more preferably 60000 dtex or less, and the most preferably 10000 dtex or less. Each of the fibers may have the fineness typically in the range of 150 to 100000 dtex, for example in the range of 300 to 60000 dtex, and preferably in the range of 1000 to 10000 dtex. Such fineness makes it possible for the steric net-like fiber aggregation upon being compressed to generate a uniform force (uniform pressure) over the entire compressed surface thereof, which means that the user's discomfort feeling attributed to a difference in force from the compressed aggregation is unlikely to arise.

The apparent density of the steric net-like fiber aggregation according to the present invention is preferably in the range of 0.020 g/cm$^3$ to 0.300 g/cm$^3$, more preferably in the range of 0.025 g/cm$^3$ to 0.200 g/cm$^3$, still more preferably in the range of 0.030 g/cm$^3$ to 0.150 g/cm$^3$, the most preferably in the range of 0.035 g/cm$^3$ to 0.100 g/cm$^3$, and the particularly most preferably in the range of 0.040 g/cm$^3$ to 0.080 g/cm$^3$. The above apparent density of the steric net-like fiber aggregation enables the aggregation to have a sufficient elasticity and an increased contacting point of the fibers with each other, which leads to a stronger structure of the steric net-like fiber aggregation. The cross-section form of the fiber in the steric net-like fiber aggregation is not limited to a particular one. For example, the cross-section form of the fiber may be a circular form, a hollowed form or a deformed form. The fiber may be made of two or more kinds of resins, in which case the cross-section of the fiber may be in a core-sheath form, an eccentric core-sheath form, a side-by-side form, a divided form, or an island-and-sea form.

The thickness of the steric net-like fiber aggregation according to the present invention is preferably in the range of 3 mm to 150 mm, more preferably in the range of 5 mm to 120 mm, still more preferably in the range of 10 mm to 100 mm, and the most preferably in the range of 20 mm to 80 mm. Such thickness of the steric net-like fiber aggregation enables the aggregation to not only have a sufficient cushioning performance, but also have a favorable structural strength and exhibit an improved machinability upon a cutting of the aggregation into smaller ones.

The steric net-like fiber aggregation of the present invention may be composed of fibers made of one kind of resin, and alternatively made of two or more kinds of resin. For example, the steric net-like fiber aggregation may comprise the mixed fibers which are different from each other in terms of the fineness, the fiber diameter and the fiber cross-section form as well as the kind of the resin. In this regard, the fibers having a higher rigidity may be located in the peripheral portion of the steric net-like fiber aggregation to improve the structural retention of the aggregation, whereas the fibers having a higher elasticity may be located in the central portion of the steric net-like fiber aggregation to improve the structural elasticity of the aggregation. Alternatively, the fibers made of the resin having a lower-melting point may be located in the peripheral portion of the steric net-like fiber aggregation to strengthen the fusion bonding of the fibers, whereas the fibers made of the resin having a higher-melting point and exhibiting the higher rigidity may be located in the central portion of the steric net-like fiber aggregation. Moreover, the steric net-like fiber aggregation of the present invention may also have a stacked structure with another steric net-like fiber aggregation made of another resin material such as polyethylene-based polymer and the like. The term "peripheral portion" as used herein means a local portion of 1 to 45% from each of the surfaces of the steric net-like fiber aggregation with respect to 100% of the total thickness of the steric net-like fiber aggregation. While on the other hand, term "central portion" as used herein means another local portion of the steric net-like fiber aggregation other than the above peripheral portion.

The steric net-like fiber aggregation of the present invention may have a layer-stacking structure composed of a plurality of sub-steric net-like fiber aggregations. For example, the steric net-like fiber aggregation of the present invention may have a multi-layer structure of the sub-aggregations stacked with each other in a form of layers, the sub-aggregations being different from each other in the kind of resin, fiber fineness, apparent density or the like. In this regard, the steric net-like fiber aggregation may have a three-layered structure wherein the two outer-sided sub-aggregations have the smaller fineness of the fibers, whereas the center-sided sub-aggregation has the higher rigidity of the fibers. This enables the steric net-like fiber aggregation to not only have a favorable texture at the outer side of the aggregation, but also have the sufficient rigidity as the whole structure of the aggregation. The method for bonding the sub-aggregations with each other is not limited to a particular one, and may be a thermal fusion bonding, an adhesive-applying bonding or the like.

The steric net-like fiber aggregation of the present invention has the chemical resistance, and thus does not substantially undergo its weight loss after a sterilization treatment in which the aggregation is immersed into a chemical. Examples of the chemical include an alcohol (e.g., ethanol, and the like). By way of example, a weight change rate of the steric net-like fiber aggregation is 0% after the immersion of the steric net-like fiber aggregation into the ethanol (e.g., ethanol particularly used for the sterilization treatment at the hospital or the like) during the whole day. This makes it possible for the user to use the steric net-like fiber aggregation in its clean condition without a deformation of the aggregation even in a case of a repetitive use of the aggregation. The steric net-like fiber aggregation of the present invention does not generate an odor, and also does not absorb the surrounding odor, followed by releasing of such absorbed odor therefrom. Moreover, the steric net-like fiber aggregation of the present invention does not bring about the sticky feeling for the user. As a result, there can be provided a comfort use of the steric net-like fiber aggregation for the user. It should be noted that the generating of odor, the releasing of the absorbed odor, and the sticky feeling are peculiar to the aggregation made of the polyester-based polymer. In a case where the steric net-like fiber aggregation comprises the polymer alloy as described above, the aggregation can exhibit an improved heat resistance as well as the further improved chemical resistance. This enables the steric net-like fiber aggregation of the present invention to be positively subjected to a washing treatment and/or sterilization treatment under a condition of high temperature, which means that the aggregation of the present invention is suitably used as a medical or nursing-care appliance. The weight change rate as used herein is based on the weight of the aggregation (each sample of the aggregation) at a point in time before the immersion thereof into the chemical.

It is preferred in the steric net-like fiber aggregation that a compression stress does not undergo a large change between a lower compressibility condition and a higher compressibility condition. In a preferred embodiment of the present invention, a ratio of the compression stress under the compressibility of 50% to the compression stress under the compressibility of 25%, which can represent a stability in terms of compression stress, is preferably in the range of 1.2 to 5.0, more preferably in the range of 1.5 to 3.5, and the most preferably in the range of 1.7 to 3.0. Such ratio enables the force generated upon the compression of the steric net-like fiber aggregation to be unlikely to greatly vary in spite of the difference in the compressibility of the aggregation, which means that the steric net-like fiber aggregation of the present invention does not undergo a radical sinking. As a result, the user does not sink too much while feeling no unsatisfactory hardness of the steric net-like fiber aggregation when being seated thereon. For this reason, the steric net-like fiber aggregation of the present invention can be suitably used as the medical or nursing-care appliance such as a corset and the like, in which case the user's stress can be mitigated upon contacting of the user's skin with the corset.

The manufacturing method for the steric net-like fiber aggregation of the present invention will now be described for an exemplary purposes.

A twin screw extruder is used to melt and mix a resin raw material, wherein the extruder is heated to the temperature of the melting point or higher of the resin raw material. In a case where a polymer alloy is used as the resin raw material, a plurality of resin raw material pellets from which the polymer alloy is provided are charged into the twin screw extruder at once, followed by being subjected to the melting and mixing. Subsequently, a fiber spinning is performed by continuously discharging the melted resin raw material downward from a T-die having a plurality of pores, which leads to a production of the steric net-like fiber aggregation of the present invention. A water bath (or hot-water bath) is located immediately below the T-die, and two conveyors are disposed in parallel in the bath wherein a part of the conveyors is positioned above the water surface of the bath. The fibers coming from the T-die in their melted resin state receive the buoyant force from the bath when they reach the water surface of the bath between the two conveyors, thereby becoming to have a random orientation. In this regard, a multitude of the fibers are allowed to pass between the two conveyors in the water bath, while being subjected to a heat removal. This leads to a fusion bonding of the fibers with each other while the fibers being solidified, whereby there can be eventually formed the steric net-like fiber aggregation. The thickness of the steric net-like fiber aggregation can be determined by the clearance dimension of the two conveyors. The produced aggregation from the bath is then subjected to a cutting process wherein the aggregation is cut into ones with suitable length dimensions and/or shapes. Thereafter, a drying process for the steric net-like fiber aggregation is performed. The drying process may be performed alternatively at a point in time before the cutting process.

An additional process, an antioxidizing treatment, a flame-retardant treatment, a coloring treatment, a light-stabilizing treatment, an antiblocking treatment, an antistatic treatment, a mildew proofing treatment, a fragrance treatment, and the like may be performed at any suitable point in time during the manufacturing process of the steric net-like fiber aggregation.

The steric net-like fiber aggregation of the present invention can be used as a medical appliance, a nursing-care appliance, or the like. The medical or nursing-care appliance is generally required to undergo an inactivation/sterilization treatment to prevent an infection with a virus or a bacterium. In this regard, the steric net-like fiber aggregation of the present invention, which has the improved resistance for chemicals, can withstand the repetitive use thereof with no deformation of the aggregation even when the chemical treatment of the aggregation is conducted. The term "medical or nursing-care appliance" as used herein means an aid product/tool used in the field of medical or nursing-care. Examples of the medical or nursing-care appliance include a medical or nursing-care bed or chair/couch, a cushion material for an operating table and the like, a floor material for a bathroom, a restroom (toilet) and the like, a cushion material in general, a medical or nursing-care supporter/fixing (especially a core material or belt material for a neck or waist corset and the like), and the like.

The cushion feeling of the steric net-like fiber aggregation according to the present invention can contribute to a suitable use of the aggregation as the medical or nursing-care appliance. Further, the chemical resistance of the steric net-like fiber aggregation according to the present invention can contribute to the repetitive use of the aggregation in a clean state of the aggregation. The steric net-like fiber aggregation of the present invention can also be used for bedclothes in general such as a mattress, pillow and the like, and also used as a core material for furniture such as a couch/chair, a sofa and the like. Due to the chemical resistance of the steric net-like fiber aggregation of the present invention, a deformation of the aggregation is unlikely to occur even after a maintenance treatment (e.g., sterilization treatment or the like) thereof using the chemical, which leads to an achievement of the clean repetitive use of the aggregation. In a case where the steric net-like fiber aggregation of the present invention is used as the core material, it is preferred that an unwoven cloth, a quilting cloth, a woven cloth or a knit cloth may be additionally used as a surface-skin part (e.g., cover) for the aggregation. It is more preferable that the unwoven cloth, the quilting cloth, the woven cloth and the knit cloth are ones made of polypropylene. In recent years, the resin materials used in field of the auto industry tend to be replaced with a polypropylene material. The steric net-like fiber aggregation of the present invention, which mainly consists of propylene, can be thus suitably used for an automotive application.

EXAMPLES

The present invention will now be described in more detail, referring to Examples and Comparative examples although the present invention is not necessarily limited to them.

The twin screw extruder was used to mix the component(s) according to Table 1. The temperature of the twin screw extruder from upstream to downstream thereof was set stepwise from about 140° C. to about 200° C. The melting and mixing process in the twin screw extruder was performed at 1000 rpm, and subsequently the melted resin was continuously discharged downward from the T-die with its temperature of about 200° C. The fibrous resin discharged from the plurality of pores of the T-die was allowed to enter the water bath (room temperature) located immediately below the T-die, followed by being allowed to pass between the two parallel conveyors disposed in the bath. As a result, the fibers made of the resin were forced to undergo a fusion bonding with each other, whereby there was eventually formed the steric net-like fiber aggregation.

Regarding Examples 1-7 and Comparative examples 1-2 listed in Table 1, the following were used as the components "a" and "b".

Component "a": Propylene-Based Polymer

- Component "a-1": WELNEX™ STR0729 produced by Japan Polypropylene (Metallocene-catalyzed random copolymer), Weight-average molecular weight $M_w$ 320000, Molecular weight distribution $M_w/M_n$ 2.50, Propylene (75 mol %):Ethylene (25 mol %)
- Component "a-2": WELNEX™ STR0730 produced by Japan Polypropylene (Metallocene-catalyzed random copolymer), Weight-average molecular weight $M_w$ 320000, Molecular weight distribution $M_w/M_n$ 2.50, Propylene (75 mol %):Ethylene (25 mol %)
- Component "a-3": PRIMALLOY™ A1700 produced by Mitsubishi Chemical Corporation (Polyester-based thermoplastic elastomer)
- Component "a-4": KERNEL™ KS571 produced by Japan Polyethylene Corporation (polyethylene-based copolymer: copolymer of polyethylene and α-olefin)

Component "b": Propylene Homopolymer

- Component "b-1": GC4301 produced by Japan Polypropylene Corporation, Weight-average molecular weight $M_w$ 330000, Molecular weight distribution $M_w/M_n$ 3.86
- Component "b-2": NOVATEC™ MA-2 produced by Japan Polypropylene Corporation, Weight-average molecular weight $M_w$ 426000, Molecular weight distribution $M_w/M_n$ 3.41

TABLE 1

| Blending (parts by mass) | Examples | | | | | | | Comparative examples | |
|---|---|---|---|---|---|---|---|---|---|
| | 1 | 2 | 3 | 4 | 5 | 6 | 7 | 1 | 2 |
| Component (a-1) | 100 | | 80 | 60 | 70 | 50 | 30 | | |
| Component (a-2) | | 100 | | | | | | | |
| Component (a-3) | | | | | | | | 100 | |
| Component (a-4) | | | | | | | | | 100 |
| Component (b-1) | | | 20 | 40 | | | | | |
| Component (b-2) | | | | | 30 | 50 | 70 | | |

For each of the steric net-like fiber aggregations as described above, the fineness, the thickness, the apparent density, and the mass per unit area were determined. The results for the determinations are listed below in Table 2. Regarding the determination for the commercially available steric net-like fiber aggregation, Comparative example 3 was also conducted, the commercially available aggregation being made of an polyethylene-based copolymer (AIR-WEAVE™, AWC-01 with no cover). As for the determined values listed in Table 2, they are ones that were respectively averaged for ten or more samples in each of the aggregations.

TABLE 2

| | Examples | | | | | | | Comparative examples | | |
|---|---|---|---|---|---|---|---|---|---|---|
| | 1 | 2 | 3 | 4 | 5 | 6 | 7 | 1 | 2 | 3 |
| Fineness (dtex) | 1900 | 5000 | 5400 | 5600 | 8200 | 8500 | 8850 | 1800 | 2800 | 4100 |
| Thickness (mm) | 37.8 | 28.9 | 28.8 | 33.7 | 35.9 | 35.5 | 35.2 | 23.5 | 61.3 | 36.0 |
| Apparent density ($g/cm^3$) | 0.040 | 0.063 | 0.078 | 0.065 | 0.063 | 0.060 | 0.057 | 0.072 | 0.040 | 0.064 |
| Mass per unit area ($kg/m^2$) | 1.51 | 1.82 | 2.25 | 2.19 | 2.26 | 2.13 | 2.00 | 1.69 | 2.45 | 2.30 |

Moreover, the following evaluation tests were conducted for each of the steric net-like fiber aggregations.

1. Odor Evaluation

Each of the steric net-like fiber aggregations produced as described above according to Table 1 was cut to provide a sample piece with its size of 200 mm by 200 mm. Each sample piece was kept in the shade and airy area for a week, and thereafter was left in the medical room (with its size of about six-tatami) at the hospital (Kansai-region hospital) for the whole 3 days. Each of the resultant sample pieces was subjected to a sensory test on odor. Such sensory test was conducted at a point in time before and after the sample piece was left in the above medical room of the hospital. The evaluations for the sensory test were done for three persons (i.e., two males and one female). The evaluation "○" (GOOD) was given in the case of no odor or no disturbing, the evaluation "Δ" (MEDIOCRE) was given in the case of slight odor or a little disturbing, and the evaluation "×" (BAD) was given in the case of odor or disturbing. As for the sensory test before the disposing of the sample piece in the medical room of the hospital, it was conducted immediately after an enclosing of the sample piece in the plastic bag for 10 minutes. The results for the sensory test are shown in Table 3.

TABLE 3

| | | Examples | | | | | | | Comparative examples | | |
|---|---|---|---|---|---|---|---|---|---|---|---|
| | | 1 | 2 | 3 | 4 | 5 | 6 | 7 | 1 | 2 | 3 |
| Male 1 | Before left | ○ | ○ | ○ | ○ | ○ | ○ | ○ | x | ○ | ○ |
| | After left | ○ | ○ | ○ | ○ | ○ | ○ | ○ | x | ○ | ○ |
| Male 2 | Before left | ○ | ○ | ○ | ○ | ○ | ○ | ○ | Δ | ○ | ○ |
| | After left | ○ | ○ | ○ | ○ | ○ | ○ | ○ | x | ○ | ○ |
| Female 1 | Before left | ○ | ○ | ○ | ○ | ○ | ○ | ○ | Δ | ○ | ○ |
| | After left | ○ | ○ | ○ | ○ | ○ | ○ | ○ | x | ○ | ○ |

As can be seen from Table 3, the steric net-like fiber aggregation according to the present invention exhibited a better result of the sensory test both before and after the sample piece had been left in the medical room of the hospital, which means that the steric net-like fiber aggregation of the present invention has a less odor. While on the other hand, the steric net-like fiber aggregation according to Comparative example 1 wherein the aggregation was made of the polyester-based thermoplastic elastomer had odor before the sample piece had been left in the medical room at the hospital, and also had tendency to get worse in its odor after the sample piece had been left in the medical room.

2. Chemical Resistance Evaluation

Each of the steric net-like fiber aggregations produced as described above according to Table 1 was cut to provide a sample piece with its size of 20 mm by 50 mm. Each sample piece was immersed in an ethanol (KISHIDA CHEMICAL Co., Ltd., primary alcohol, product code: 010-28555) for 1 day (i.e., during the whole day) under a room temperature. The ethanol was one used for a sterilization treatment at the hospital and the like. The evaluation "○" (GOOD) was given in the case where the weight change rate after the above 1 day was 0%, the evaluation "Δ" (MEDIOCRE) was given in the case where the weight change rate after the above 1 day was higher than 0% and 1% or lower, and the evaluation "Δ" (BAD) was given in the case where the weight change rate after the above 1 day was higher than 1%. The weight change rate in this evaluation was based on the weight of each sample piece at a point in time before the immersion of the sample piece into the ethanol. The results for the chemical resistance evaluation are shown in Table 4.

3. Heat Resistance Evaluation

Each of the steric net-like fiber aggregations produced as described above according to Table 1 was cut to provide a sample piece with its size of 100 mm by 100 mm. In light of the fact that a hot-water treatment (100° C.) or a heat treatment (121-135° C.) is usually conducted at the hospital as a sterilization treatment, each sample piece was placed for 30 minutes in a thermostatic chamber (100° C., 121° C., 135° C.) under an atmospheric pressure. The evaluation "○" (GOOD) was given in the case where all of dimension change rates (i.e., change rates of depth dimension, width dimension and height dimension of sample piece) after the above 30 minutes was ±5% or less, the evaluation "Δ" (MEDIOCRE) was given in the case where the all of dimension change rates of the sample piece after the above 30 minutes was more than ±5% and 70% or less, and the evaluation "×" (BAD) was given in the case where the sample piece had been dissolved. The dimension change rate in this evaluation was based on the depth dimension, width dimension and height dimension of each sample piece at a point in time before the placement of the sample piece into the thermostatic chamber. The results for the heat resistance evaluation are shown in Table 4.

4. Compression Stress Stability Evaluation (Evaluation of Stability in Terms of Compression Stress)

Each of the steric net-like fiber aggregations produced as described above according to Table 1 was cut to provide a sample piece with its size of 200 mm by 200 mm. For each sample piece, a compression stress test was conducted according to JIS K 6400 using Tensilon (RTG-1250A, Orientec Corporation). A pressure plate with ϕ100 was used, 50 mm/minute was employed as a test speed, and also no preliminary compression was conducted. The compression stresses under the compressibility of 25% and 50% were determined, and thereby a ratio of the compression stress under the compressibility of 50% to the compression stress under the compressibility of 25% was calculated. As for such ratio, a lower one indicates that a difference in compression stress is smaller between a higher compressibility condition (such as 50% compressibility and the like) and a lower compressibility condition (such as 25% compressibility and the like). The results for the compression stress test are shown in Table 4.

TABLE 4

| | Examples | | | | | | | Comparative examples | | |
|---|---|---|---|---|---|---|---|---|---|---|
| | 1 | 2 | 3 | 4 | 5 | 6 | 7 | 1 | 2 | 3 |
| Odor (Sensory test) | ○ | ○ | ○ | ○ | ○ | ○ | ○ | x | ○ | ○ |
| Chemical resistance (weight change ratio after immersion into ethanol) | ○ | ○ | ○ | ○ | ○ | ○ | ○ | x | Δ | Δ |

TABLE 4-continued

| | | Examples | | | | | | | Comparative examples | | |
|---|---|---|---|---|---|---|---|---|---|---|---|
| | | 1 | 2 | 3 | 4 | 5 | 6 | 7 | 1 | 2 | 3 |
| Heat resistance (dimension stability after 30 minutes) | Temperature condition: 100° C. | ○ | ○ | ○ | ○ | ○ | ○ | ○ | ○ | ○ | x |
| | Temperature condition: 121° C. | x | x | ○ | ○ | ○ | ○ | ○ | ○ | x | x |
| | Temperature condition: 135° C. | x | x | ○ | ○ | ○ | ○ | ○ | ○ | x | x |
| Compression stress stability (50% compression strength/ 25% compression strength) | | 1.76 | 1.90 | 2.80 | 2.10 | 1.90 | 1.87 | 2.08 | 1.80 | 1.60 | 1.50 |

As can be seen from the above results, the steric net-like fiber aggregations of the present invention according to Examples 1 and 2 had the improved chemical resistance. The steric net-like fiber aggregations of the present invention also had the favorable results for the compression stress stability, which means that the aggregation according to the present invention does not undergo a large variation in the compression stress even when the different compressibility conditions are given. For example, the user's stress received from the compressed aggregation can be mitigated in the present invention since the variation in the pressure applied onto the user by the compressed aggregation can be suppressed. Further, as can be seen from Examples 3-7, the steric net-like fiber aggregations produced using the polymer alloy according to the present invention had the favorable results for the heat resistance evaluation at the temperature conditions of 121° C. and 135° C. as well as 100° C. This means that the steric net-like fiber aggregation of the present invention has the more improved heat resistance. In this regard, such higher heat resistance makes it possible for the user to repeatedly use the steric net-like fiber aggregation without a deformation of the aggregation even when a high-temperature cleaning/sterilization treatment thereof is conducted. Furthermore, as can be seen from Examples 1-7, the steric net-like fiber aggregations according to the present invention had the favorable results for the odor evaluation. While on the other hand, as can be seen from Comparative example 1, the steric net-like fiber aggregation produced using the polyester-based thermoplastic elastomer had the poor result for the chemical resistance evaluation, which means that such aggregation cannot solve the problem associated with the present invention. The steric net-like fiber aggregation according to Comparative example 1 also had the poor result for the odor evaluation, and the sticky surface of the aggregation according to Comparative example 1 was also observed, which brought about the discomfort feeling of the user in terms of texture and odor of the aggregation. Moreover, as can be seen from Comparative examples 2 and 3, the steric net-like fiber aggregations produced using the polyethylene-based polymer had the poor results for the chemical and heat resistances despite the favorable result for the compression stress stability.

Although some embodiments of the present invention have been hereinbefore described, they are merely provided as typical examples of the present invention. It will be readily appreciated by those skilled in the art that the present invention is not limited to the embodiments as described above, and thus various modifications thereof are possible without departing from the scope of the present invention.

INDUSTRIAL APPLICABILITY

The steric net-like fiber aggregation of the present invention can be used in the medical/nursing-care device or the like. For example, the steric net-like fiber aggregation of the present invention can be used in a medical or nursing-care bed or chair/couch, a cushion material for an operating table or the like, a floor material for a bathroom, a restroom (toilet) or the like, a cushion material in general, a medical or nursing-care supporter/fixing (especially a core material or belt material for a neck or waist corset or the like), or the like.

CROSS REFERENCE TO RELATED PATENT APPLICATION

The present application claims the right of priority of Japanese Patent Application No. 2014-139015 (filed on Jul. 4, 2014, the title of the invention: "STERIC NET-LIKE FIBER AGGREGATION"), the disclosure of which is incorporated herein by reference in its entirety.

The invention claimed is:

1. A steric net-like fiber aggregation, comprising fibers having a fineness of 150 to 60000 dtex, the fibers being made of a resin that is a polymer alloy made of a propylene-based polymer(a) and a propylene homopolymer(b), wherein the steric net-like fiber aggregation has a structure formed of a multitude of the fibers fusion bonded in a random orientation with each other, wherein the propylene-based polymer(a) has a structural unit of 51 to 95 percent by mole of a propylene and 5 to 49 percent by mole of an α-olefin with respect to 100 percent by mole of the total monomers of the propylene-based polymer(a), wherein the steric net-like fiber aggregation has an apparent density in the range of 0.020 g/cm$^3$ to 0.300 g/cm$^3$, wherein the steric net-like fiber aggregation has a thickness in the range of 5 mm to 120 mm, and wherein a ratio of a compression stress under a compressibility of 50% to the compression stress under the compressibility of 25% is in the range of 1.7 to 3.0.

2. The steric net-like fiber aggregation according to claim 1, wherein a number of carbon atoms contained in the α-olefin is 2 to 10.

3. The steric net-like fiber aggregation according to claim 2, wherein the α-olefin with the number of the carbon atoms contained therein being 2 to 10 is at least one selected from a group consisting of ethylene, 1-butene, 1-pentene, 1-hexene and 1-octene.

4. The steric net-like fiber aggregation according to claim 1, wherein the propylene-based polymer(a) has a molecular weight distribution $M_w/M_n$ of 4.0 or less.

5. The steric net-like fiber aggregation according to claim 1, wherein the polymer alloy comprises 10 to 80 percent by weight of the propylene homopolymer(b) with respect to 100 percent by weight of the whole polymer alloy.

6. The steric net-like fiber aggregation according to claim 1, wherein the propylene homopolymer(b) has a molecular weight distribution $M_w/M_n$ of 2.0 to 6.0.

7. The steric net-like fiber aggregation according to claim 1, wherein a weight change rate of the steric net-like fiber aggregation is 0% after an immersion of the steric net-like fiber aggregation into an alcohol during the whole day.

8. The steric net-like fiber aggregation according to claim 1, wherein the steric net-like fiber aggregation is one used as a medical or nursing-care appliance.

9. The steric net-like fiber aggregation according to claim 1, wherein the structure of the steric net-like fiber aggregation is formed due to the fusion bonding of the multitude of the fibers through a buoyant force of a water bath.

10. The steric net-like fiber aggregation according to claim 1, wherein the ratio of a compression stress under a compressibility of 50% to the compression stress under the compressibility of 25% is in the range of 1.9 to 3.0.

11. The steric net-like fiber aggregation according to claim 1, wherein the ratio of a compression stress under a compressibility of 50% to the compression stress under the compressibility of 25% is in the range of 2.08 to 3.0.

12. The steric net-like fiber aggregation according to claim 1, wherein the propylene-based polymer(a) has a structural unit of 70 to 80 percent by mole of the propylene and 20 to 30 percent by mole of the α-olefin with respect to 100 percent by mole of the total monomers of the propylene-based polymer(a).

13. The steric net-like fiber aggregation according to claim 1, wherein the polymer alloy in the steric net-like fiber aggregation comprises the propylene homopolymer(b) in the range of 10 to 50 weight % with respect to 100 weight % of the whole polymer alloy.

* * * * *